US005741443A

United States Patent [19]

Gemza

[11] Patent Number: 5,741,443

[45] Date of Patent: Apr. 21, 1998

[54] OXYGENATION OF STRATIFIED WATER

[76] Inventor: Andy Gemza, c/o Ontario Ministry of Environment and Energy, 125 Resources Road, Etobicoke, Ontario, Canada, M9P 3V6

[21] Appl. No.: 755,100

[22] Filed: Nov. 22, 1996

[51] Int. Cl.[6] ..... B01F 3/04

[52] U.S. Cl. ..... 261/77; 261/120; 261/93

[58] Field of Search ..... 261/77, 93, 120

[56] References Cited

U.S. PATENT DOCUMENTS

| | | | |
|---|---|---|---|
| 2,825,541 | 3/1958 | Moll et al. | 261/120 |
| 3,794,303 | 2/1974 | Hirshon | 261/77 |
| 3,865,908 | 2/1975 | Hirshon | 261/77 |
| 4,044,720 | 8/1977 | Fast | 261/77 |
| 4,060,574 | 11/1977 | Verner et al. | 261/77 |
| 4,107,240 | 8/1978 | Verner et al. | 261/77 |
| 4,347,143 | 8/1982 | Righetti | 210/758 |
| 4,549,997 | 10/1985 | Verner et al. | 261/77 |
| 4,724,086 | 2/1988 | Kortmann | 261/77 |
| 4,780,217 | 10/1988 | Petersen | 210/758 |
| 5,078,923 | 1/1992 | Durda et al. | 261/120 |

*Primary Examiner*—Tim R. Miles

*Attorney, Agent, or Firm*—Bereskin & Parr

[57] ABSTRACT

An apparatus and method for introducing oxygen into a subsurface stratum of a thermally stratified body of water, while maintaining the thermal stratification thereof substantially undisturbed, comprising a closed flow path wherein water enters an inflow aperture, extends upwardly through an upflow chamber, through a horizontal chamber, downwardly through a downflow chamber, and through an outflow aperture. Both the inflow aperture and the outflow apertures are positioned within the subsurface stratum. Within the conduit is an aerator which introduces oxygen, an impeller which assists the flow of water through the conduit and which mixes water with oxygen, and a collector which collects undissolved gas within the conduit at the horizontal chamber. Outside the conduit, and above the outflow aperture, an interceptor means collects undissolved gas outside of the outflow aperture, and prevents vertical circulation of water discharged from the outflow aperture means.

22 Claims, 3 Drawing Sheets

OXYGENATION OF STRATIFIED WATER

FIELD OF THE INVENTION

The present invention relates to a method and an apparatus for oxygenating stratified water.

BACKGROUND OF THE INVENTION

Large bodies of water, such as lakes and reservoirs, may become stratified, particularly in the summer. There develops a upper, warmer layer, the epilimnion, a colder, lower layer, the hypolimnion, and border area between the two, the thermocline. The depth of these layers may vary depending on the climate and the body of water. For example, the thermocline may be situated at a depth of 4 to 10 meters. The epilimnion has contact with the atmosphere and is thereby able to assimilate some oxygen. However, the hypolimnion tends to become oxygen deprived. The thermal tolerance of some fish and other animals require that they remain within the hypolimnion for survival. As the hypolimnion becomes oxygen deprived, the survival of these animals is threatened.

To counteract this problem, oxygen may be injected into the hypolimnion. For example, perforated tubes may be laid in the hypolimnion, and compressed air may be fed through the tubes. However, air bubbles will ascend and transport hypolimnion water upwards, according to the principle of the airlift pump, and this gradually breaks down the thermal stratification of the water. By raising the temperature of the hypolimnion, fish and other animals which are dependent on cold water for survival are threatened. There is also danger, especially in small lakes, that by transporting water low in oxygen to the surface, fish living in surface water will suddenly encounter low oxygen content, and will die from lack of oxygen.

Various methods have been proposed to overcome this problem. Verner et al. (U.S. Pat. Nos. 4,060,574, 4,107,240 and 4,549,997), and Righetti (U.S. Pat. No. 4,347,143) teach apparatus and methods for oxygenating lower levels of a thermally stratified lake, wherein an oxygenation device is lowered into the hypolimnion region. The hypolimnion is oxygenated by injection of a compressed gas, while upward flow of the water is prevented by means of an air entrapping housing within the aerating apparatus. Bubbles of undissolved gases are collected in the housing and directed to the surface through a gas line. Thus the bubbles are prevented from floating independently to the surface and transporting with them water from the hypolimnion.

However, by use of this method, undissolved bubbles may be carried out of the apparatus in the flow of water through the apparatus, and disturb thermal stratification of the lake.

Furthermore, locating the body of the device in the hypolimnion makes it difficult for an operator to monitor operation of the device. There are also difficulties associated with positioning and anchoring the apparatus at the appropriate location and ensuring that it remains there. For example, problems may arise in positioning the device due to unforseen underwater hazards such as rocks.

In addition, the above-noted apparatus are not able to take advantage of a counter current flow between undissolved gas and water. A counter current flow facilitates mixing of gas and water and maximizes oxygen absorbtion over the full length of the counter current, thus maximizing oxygenation of the water.

Peterson (U.S. Pat. No. 4,780,217), Moll (U.S. Pat. No. 2,825,541), and Hirshon (U.S. Pat. Nos. 3,794,303 and 3,865,908) teach apparatus in which part of the oxygenation device remains at or near the surface of the water. In this manner, the device can be floated by securing it to a floating structure, thus the location, depth, and oxygenation functions may be more easily established and monitored. Water may be drawn from the deep water up an enclosed conduit to the surface, and mixed with oxygen. At the surface of the water undissolved gases are allowed to escape into the atmosphere. The air-water mixture is then carried back down a conduit to the hypolimnion, where it is expelled.

As with other oxygenation apparatus, there is a danger that undissolved gases will remain in the water expelled into the hypolimnion, and cause mixing of the stratified water due to bubbles rising. Peterson attempts to address this problem by allowing undissolved gases to escape into the atmosphere from the top of the riser pipe, and by maintaining a low velocity of water flowing through the system. As the mixing of the gases and the bubbles must depend on passive diffusion, this may not be sufficient to prevent bubbles from being released in hypolimnion.

Furthermore, by maintaining a low velocity of flow through the device, the apparatus is made less efficient, in terms of its ability to oxygenate a given amount of water over a given time. Yet another problem presented by maintaining a low velocity in the apparatus is that a low velocity facilitates heat exchange through the conduit walls. Cold water flowing through the portions of the apparatus near the surface may be warmed by the epilimnion, and this heat transfer depends, in part, on the flow rate through the system.

A further difficulty with the oxygenation apparatus taught by Peterson, Moll, and Hirshon is that the apparatus are difficult to transport in water that is shallower than the apparatus.

SUMMARY OF THE INVENTION

In accordance with the instant invention there is provided an apparatus for introducing oxygen into a selected subsurface stratum of a thermally stratified body of water, while maintaining the thermal stratification thereof substantially undisturbed. The apparatus comprises a conduit which includes an inflow aperture for receiving water, an upflow chamber, a horizontal chamber, a downflow chamber, and an outflow aperture for discharging water from the conduit. The water is discharged in a discharge flow path. The apparatus conduit defines a closed flow path for water entering the inflow aperture, and the flow path extends upwardly through the upflow chamber, through the horizontal chamber, downwardly through the downflow chamber, and through the outflow aperture. Both the inflow aperture and the outflow aperture are adapted to be positioned within the selected subsurface stratum.

Within the conduit is an aerator, an impeller, and a collector. The aerator is for introducing oxygen, and is positioned in the upflow chamber or adjacent to the inflow aperture. The impeller is for assisting the flow of water through the conduit and for mixing water in the conduit with oxygen, and is positioned in the conduit between the aerator means and outflow aperture. The collector is for collecting undissolved gas within the conduit, and is positioned on the horizontal chamber.

The apparatus also comprises an interceptor means for collecting undissolved gas from said discharge flow path, and for preventing vertical circulation of water discharged from the outflow aperture. The interceptor means is positioned over and above the discharge flow path and within the selected subsurface stratum.

In one embodiment the inflow aperture means and the outflow aperture means may be a distance of between 4 and 40 metres from the horizontal chamber. In use, the apparatus may be substantially submerged in water, hence the inflow and outflow aperture will extend into the selected stratum while the horizontal chamber may be adjacent the surface of the water. Preferably, the upflow chamber or the downflow chamber or both will extend substantially vertically.

In a preferred embodiment, the impeller means is positioned in the horizontal chamber between the upflow chamber and the collector. In another preferred embodiment, the collector is positioned over and above the downflow chamber.

In other preferred embodiments, the apparatus may further comprise gas return means for returning gas from the interceptor means or from the collector, to the closed flow path of the apparatus. Preferably, the gas will be returned to the horizontal chamber, and more preferably the gas will be returned to a position adjacent to the impeller means.

The invention also includes a method for introducing oxygen into a selected subsurface stratum of a thermally stratified body of water, while maintaining the thermal stratification thereof substantially undisturbed. The method comprises the steps of drawing water upwardly from the selected subsurface stratum into a conduit having a closed flow path, causing said water drawn in to flow upwardly to adjacent the surface of said body of water, introducing oxygen into said upwardly flowing water, causing said water in said flow path to flow substantially horizontally adjacent to the surface of said body of water, mixing said water and said oxygen in an impeller means, causing said water in said closed flow path to flow downwardly, collecting undissolved gas at a portion of said closed flow path adjacent to the surface of said body of water, discharging said water from said closed flow path into said selected subsurface stratum in a discharge flow path and, within said subsurface stratum, collecting undissolved gas from said discharge flow path and limiting upward movement of water from said discharge flow path.

In a preferred embodiment, the method also comprises accelerating the flow of said water in the conduit. In another preferred embodiment, the method also comprises returning gas collected from the closed flow path, or from the discharge flow path, to a portion of said closed flow path adjacent to the surface of the body of water.

BRIEF DESCRIPTION OF THE DRAWINGS

These and other advantages of the present invention will be more fully and particularly understood in conjunction with the following description of the following drawings of the preferred embodiments of the invention in which.

DETAILED DESCRIPTION OF A PREFERRED EMBODIMENT

Figure 1:
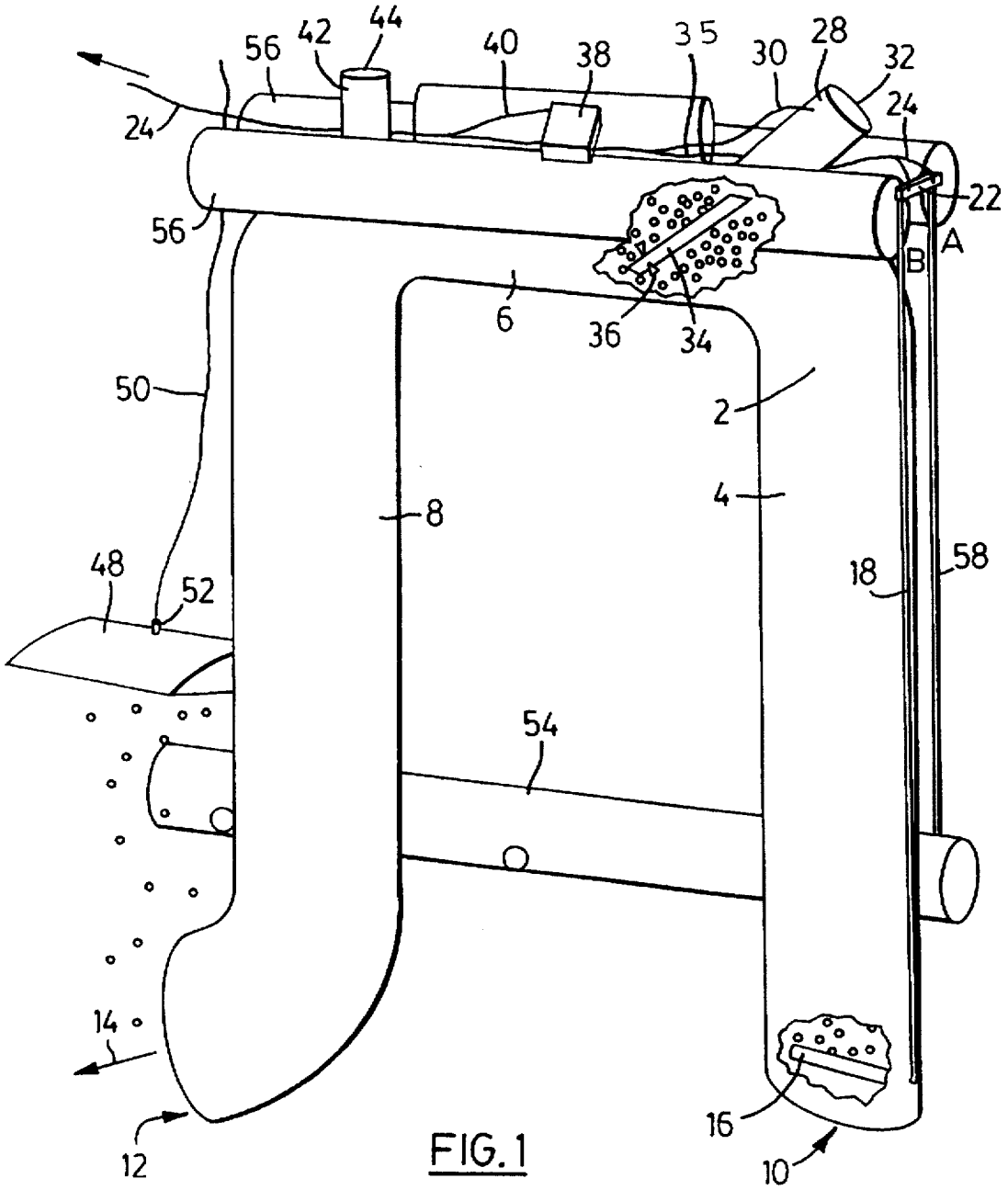
FIG. 1 is perspective view of an oxygenation apparatus.

For the purpose of promoting and understanding the principles of the invention, reference will now be made to the embodiments illustrated in the drawings and specific language will be used to described the same.

FIG. 1 is a preferred embodiment of an oxygenation apparatus. The oxygenation apparatus comprises a conduit 2, which includes upflow chamber 4, horizontal chamber 6, downflow chamber 8, inflow aperture 10, and outflow aperture 12. Conduit 2 defines an essentially closed flow path in which water enters inflow aperture 10, moves upwardly through an upflow chamber 4, across horizontal chamber 6, down through downflow chamber 8 and discharges from outflow aperture 12. Upon discharge from outflow aperture 12 the discharge water forms a discharge flow path 14.

Located within upflow chamber 4, and advantageously, adjacent to inflow aperture 10, is aerator 16. In FIG. 1, aerator 16 is shown within an exploded view of a portion of conduit 2. Aerator 16 can be selected among those of conventional construction, such as turbine injectors, scrubbers, porous plates, ejectors and the like. Aerator 16 is connected to aerator gas line 18.

Figure 2:
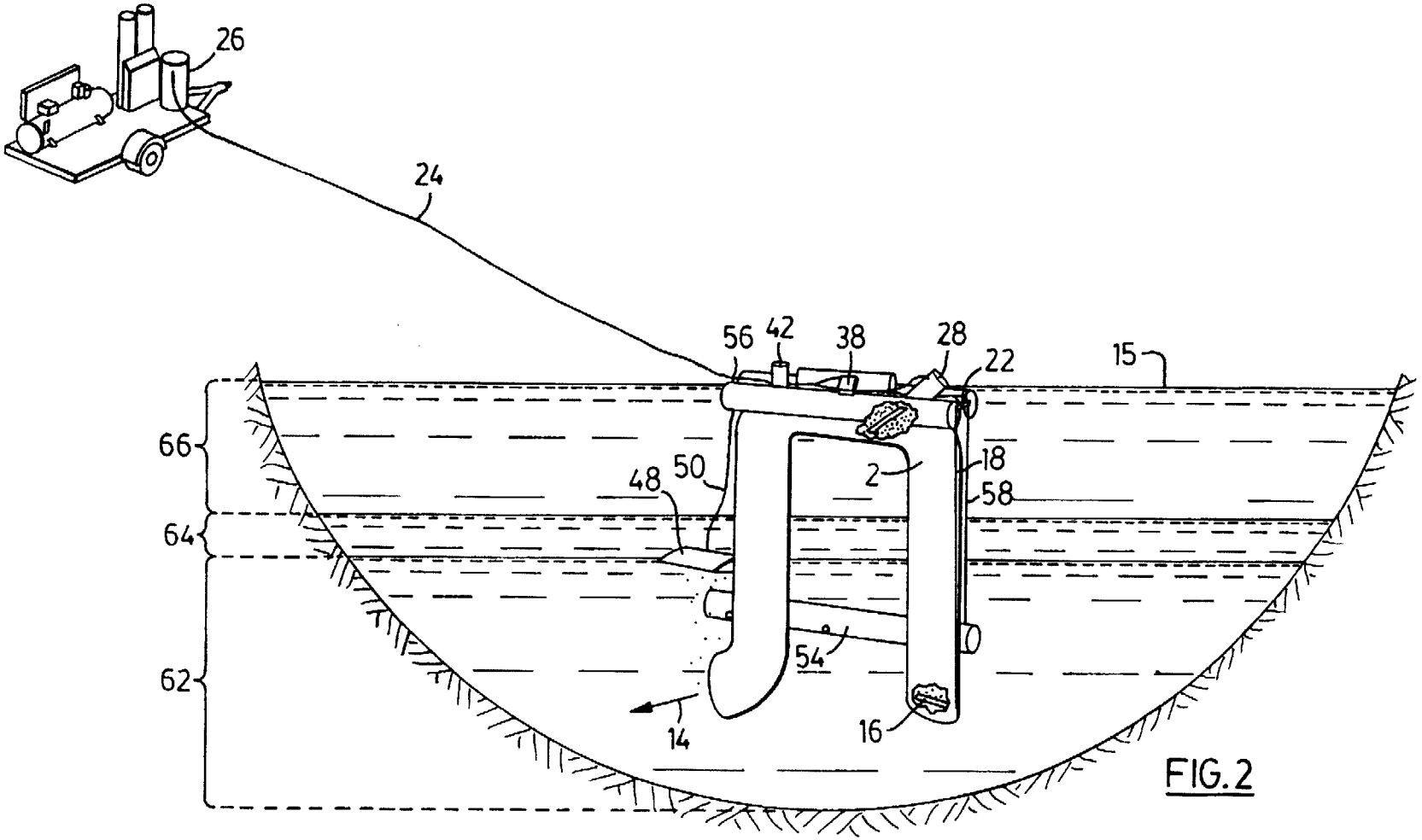
FIG. 2 is perspective view of an oxygenation apparatus positioned in a body of water, and in relation to a gas supply.

Aerator gas line 18 is a closed tube which extends from gas flow selector 22 to aerator 16. As shown in FIG. 2, gas flow selector 22 receives a flow of gas from gas pump 26 through gas supply line 24. Gas supply line 24 is a closed tube which extends from gas pump 26 to gas flow selector 22.

It will be appreciated that gas lines can be made of any material, so long as they are substantially impermeable to gas and form a closed pathway for the flow of gas. In a preferred embodiment, the gas lines will be made with a flexible tubing, such as rubber, a synthetic polymer, or the like.

The terms "gas" and "gases" encompass any gaseous mixture, including oxygen. The term "oxygen" encompasses any gaseous mixture comprising molecular oxygen as a constituent in sufficient amount to oxygenate the lake water. This would include pure oxygen, air or any other suitable gases.

An impeller means 28 extends into horizontal chamber 6. Impeller means 28 comprises an impeller body 32, impeller shaft 34 extending from impeller body 32, and propeller 36 secured to impeller shaft 34. In FIG. 1, impeller shaft 34 and propeller 36 are shown within an exploded view of a portion of conduit 2. While in the preferred embodiment described, impeller means 28 comprises a mechanical propeller apparatus, it will be appreciated that other devices could be used in addition to, or in place of, the impeller means described, so long as they assist the flow of water through conduit 2 and assist in mixing the water with the oxygen. Impeller means 28 is in flow communication with gas flow selector 22 by means of impeller gas supply line 35. Impeller electrical supply 30 is connected to impeller means 28, and supplies electrical power to drive the propeller.

Impeller electrical supply 30 is also connected to junction 38. Junction 38 may be a control means, or it may connect the apparatus to a control means, for example, by main electrical supply 40 which extends to a power supply.

Electrical energy may be transmitted through electrical wires from a source on land. Alternatively, a battery may be used, alone or in conjunction with other sources of electricity, for example a solar cell or a turbine.

Figure 3:
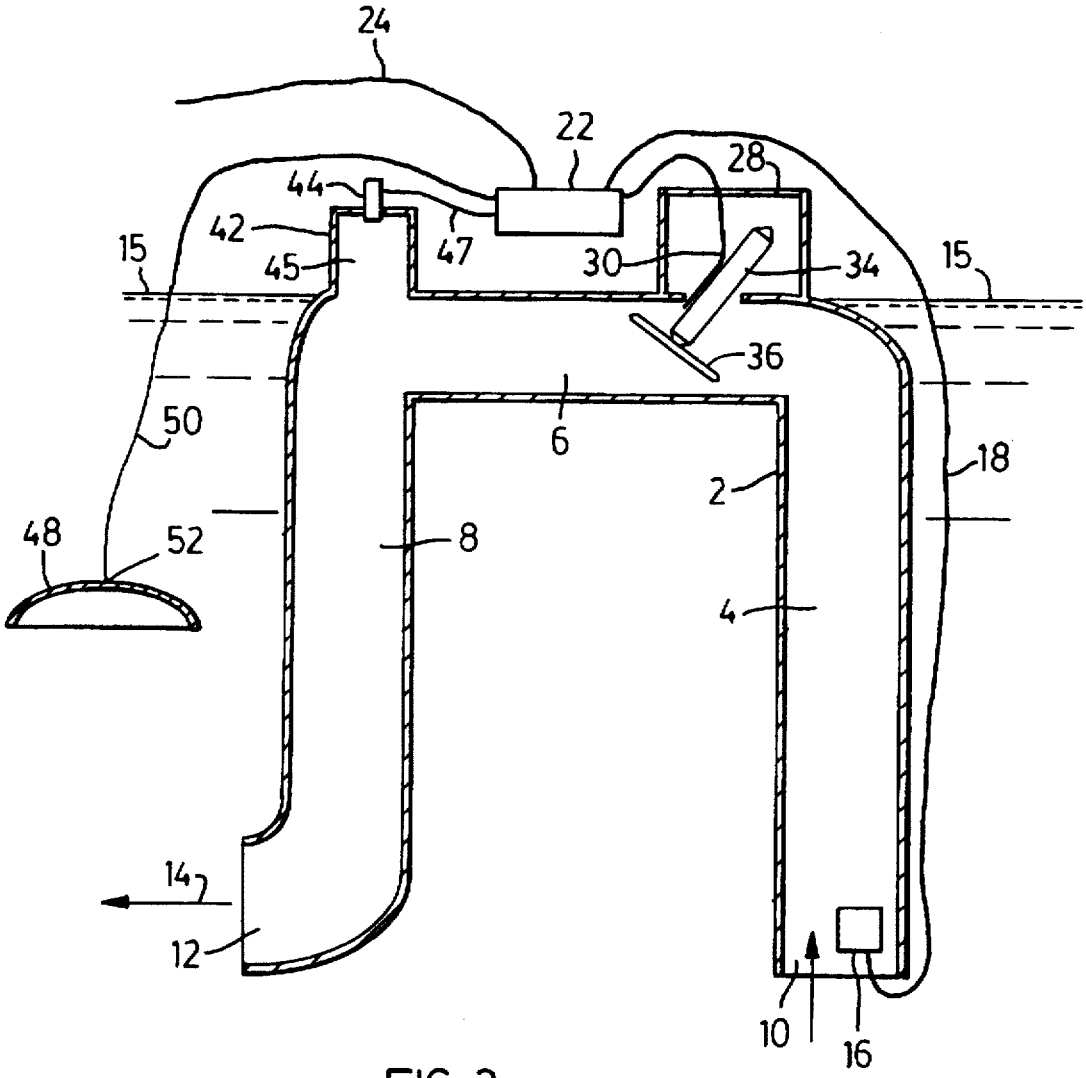
FIG. 3 is a schematic view of the gas and water flow of an oxygenation apparatus.

A collector means 42 extends upwards from horizontal chamber 6. Collector means 42 comprises collector chamber 45, as seen in FIG. 3, and purge aperture 44. Horizontal chamber 6 is in flow communication with collector chamber 45 which, in turn, is in flow communication with purge aperture 44. Gas bubbles in horizontal chamber 6 may collect in collector chamber 45 and be removed through purge aperture 44.

Upflow chamber 4 may be of substantially any shape or size, so long as it allows for the flow of water and gas from inflow aperture 10 and aerator 16, respectively, to horizontal chamber 6. Horizontal chamber 6 may be of substantially any shape or size, so long as it may facilitate the collection of some bubbles of undissolved gas into collector chamber 45. Downflow chamber 8 may be of substantially any shape or size, so long as it allows for the flow of water and gas between horizontal chamber 6 and outflow aperture 12.

Preferably, upflow chamber 4 or downflow chamber 8 or both will be substantially vertical. Substantially vertical means that the shape and orientation of the chamber is such that gas bubbles rising in the chamber will tend to rise freely, surrounded by water, as opposed to collecting on or travelling along any particular surface inside the upflow or downflow chamber. Thus, these preferred embodiments will maximize the surface contact between undissolved gas bubbles and water in chambers 4 and 8, thus maximizing the efficiency of oxygenation of the water in chamber 4 and 8.

The apparatus further comprises interceptor means 48. Interceptor means 48 is located over and above discharge flow path 14. Interceptor means 48 is connected to interceptor gas line 50. Interceptor gas line 50 is a closed tube which may transport gases upwards from interceptor means 48 to another gas flow portion of the apparatus, or to be expelled away from hypolimnion 62.

The apparatus may be supported by upper float 56 or control float 54, or both. Upper float 56 may be proximal to and may be secured to horizontal chamber 6. Control float 54 is preferably positioned adjacent to and may be secured to downflow chamber 8 and upflow chamber 4. Preferably, control float 54 is positioned adjacent to the lower portions of downflow chamber 8 and upflow chamber 4. Control float 54 is in flow communication with gas flow selector 22 through control float gas line 58. Upper float 56 is also in flow communication with gas flow selector 22, either directly (as in FIG. 1) or through an upper float gas line.

While in the preferred embodiment illustrated and described, the invention encompasses one closed flow path, one aerator means, one impeller means, one collector means, and one interceptor means, it will be appreciated that one skilled in the art could assemble an embodiment of the invention which comprises more than one aerator means, more than one closed flow path, more than one impeller means, more than one collector means, or more than one interceptor means.

In use, as shown in FIG. 2, conduit 2 is substantially submersed in a body of water, and inflow aperture 10 and outflow aperture 12 both extend downwardly from the surface of the lake so that the inflow aperture 10 and outflow aperture 12 and intercepter means 48 are located in hypolimnion 62.

Hypolimnion 62 is located below thermocline 64, which is the water layer separating hypolimnion 62 from the warmer, upper layer of the body of water, epilimnion 66. Shore mounted gas pump 26 provides to the apparatus a suitable gas under pressure. The gas is provided from gas pump 26, through gas supply line 24 to gas flow selector 22. An operator or a controller can operate gas flow selector 22 to select the direction of gas flow by opening and closing valves which allow or prevent gas from flowing through the various gas supply lines described above.

Preferably, in use, horizontal chamber 6 is positioned adjacent to and below the surface 15 of the body of water in which it is placed. In a further embodiment, as shown in FIG. 2, body 2 is positioned such that at least a portion of impeller means 28 extends upwardly out of the body of water. In this embodiment, maintenance and monitoring of the apparatus is facilitated, and sealing requirements for any motor of impeller means 28 may be minimized.

The apparatus of the invention may be positioned in a desired location as follows. By operation of gas flow selector 22, gas can be made to flow to either or both of upper float 56 and control float 54. By controlling the amount of gas in the floats, an operator can adjust the density of the floats. Conduit 2 can thus be raised or lowered to a desired position relative to the surface of the water. By providing upper float 56 at the top of the apparatus, the apparatus may be made to float at a desired height in relation to water surface 15. When floating, the apparatus can be easily moved to another location in the water by means of, for example, being towed by a boat. When arriving at a desired location an anchoring means can be used to anchor the apparatus in that location. As shown in FIG. 2, preferably the apparatus is positioned at a height such that substantially the entire conduit 2 is below water surface 15, while the uppermost portions of impeller means 28 and collector means 42 extend out of the water.

In order to stabilize the relative position of the apparatus, control float 54 may be used. Control float 54 may also be used to transport the unit almost horizontally, by filling control float 54 with gas, such that the lower portions of the apparatus are raised upwards in the water. This may be useful for transporting the apparatus in shallow water, for example, near the shore.

The flow of gas and water through the apparatus may occur as follows, and as illustrated in FIG. 3, which is a schematic of the gas and water flow through the apparatus.

By operation of gas flow selector 22, oxygen can be supplied through aerator gas line 18 to aerator 16. Aerator 16 comprises a chamber with perforations through which oxygen can escape. As the oxygen escapes aerator 16, small bubbles rise through upflow chamber 4 and carry water with it. This transports water up through upflow chamber 4 and into horizontal chamber 6. The upward flow of water draws water into conduit 2 through inflow aperture 10 which is located in the hypolimnion. Thus all water flowing upwardly in upflow chamber 4 is from the hypolimnion of the lake.

In a preferred embodiment aerator 16 is positioned within upflow chamber 4 adjacent to inflow aperture 10. Thus, water flowing into conduit 2 is exposed to oxygen almost immediately upon being drawn in, maximizing the duration of exposure of oxygen to water flowing through conduit 2.

At horizontal chamber 6 impeller shaft 34 of impeller means 28 extends into the water flowing through conduit 2. Attached to impeller shaft 34 is propeller 36. By means of, for example, an electrical motor, impeller means 28 turns impeller shaft 34 which causes propeller 36 to rotate. The location and direction of rotation of propeller 36 assists, and if desired, accelerates the flow of water through conduit 2. Also by virtue of the action of propeller 36, oxygen and water are mixed.

Further along the flow path, and in flow communication with horizontal chamber 6 is collector chamber 45. Undissolved gas bubbles may rise up out of water flowing through conduit 2 and collect in collector chamber 45. At least a portion of collector chamber 45 may be located above the water's surface. Collector chamber 45 is in flow communication with purge aperture 44. Hence, gases may rise from collector area 45 and pass through purge aperture 44, to be recirculated into gas supply line 24, gas flow selector 22, or other gas flow portions of the apparatus. Alternatively, gases leaving purge aperture 44 could be vented to atmosphere.

Continuing now with the flow of water through system, water carrying dissolved and undissolved gases will flow down downflow chamber 8, and out outflow aperture 12, defining discharge flow path 14.

Secured in a position over and above discharge flow path 14 and within hypolimnion 62 is interceptor means 48. Interceptor means 48 comprises a hoodlike structure which collects undissolved gas bubbles rising upwardly from discharge flow path 14. Interceptor means 48 is shaped such that undissolved gas bubbles generally collect at converging point 52 of interceptor means 48. Converging point 52 is in flow communication with interceptor gas line 50. Interceptor gas line 50 is a tube through which gases intercepted by interceptor means 48 may travel upwards to gas flow selector 22, or be recirculated into another gas flow portion of the apparatus. Alternately, gas flowing from interceptor means 48 through interceptor gas line 50 may be vented to atmosphere.

Preferably, gases recovered from interceptor means 48 or collector means 42 are reintroduced into conduit 2 at horizontal chamber 6. In a further preferred embodiment, gases recirculated from interceptor means 48 or collector means 42 are reintroduced into conduit 2 at impeller means 28.

As the water flowing within conduit 2 may remain below the level of water surface 15 at all times, momentum is not lost and energy is not expended lifting water above water surface 15.

By use of the apparatus, oxygenation of the body of water may occur as follows. First, oxygen may passively diffuse from gas bubbles into the water while the gas bubbles and water flow through conduit 2. In a preferred embodiment in which upflow chamber 4 or downflow chamber 8 or both are substantially vertical, gas bubbles rising in the chamber will tend to rise freely, surrounded by water, as opposed to collecting on or travelling along a surface inside the chamber. Thus, this preferred embodiment will maximize the surface contact between undissolved gas bubbles and water in conduit 2, thus maximizing the efficiency of oxygenation of the water in conduit 2.

Second, the dissolving of oxygen into water is facilitated by agitation and mixing of gas and water by impeller means 28, by facilitating contact of gas with low oxygen water, and by causing larger bubbles to be split into smaller bubbles, hence maximizing bubble surface area per volume of gas.

Third, while water flows down through downflow chamber 8, a counter current mixing occurs. As water flows downward, water pressure rises. Bubbles which are carried down downflow chamber 8 by means of the flow of the water may eventually reach a point at which the pressure of the water forcing gas bubbles upwards overcomes the force of the downward flow and gas bubbles may then rise against the water current. This counterflow, comprising the downward flow of water and the upward flow of gas, facilitates the oxygen absorbtion over the full length of downflow chamber 8. The ongoing tension between the flow forces carrying the bubbles downward and the pressure forces pushing the bubbles upward allows undissolved gas bubbles to remain within conduit 2 for a longer period of time, thus allows for greater opportunity for the gas bubbles to dissolve into the water. The counter current flow between gas bubbles and water also induces further mixing of the gas and water, thus facilitating oxygen further dissolving into the water.

By use of these various steps of gas transfer the oxygenation of hypolimnion 62 can occur at an efficient rate.

Prevention of mixing of the thermal strata of the body of water occurs as follows. First, the flow of water and addition of gas occurs substantially within conduit 2, which is a closed system, hence does not allow the strata to mix.

Second, gas bubbles which do not dissolve in the water and are not carried out of conduit 2 in discharge flow path 14 move upwardly, and are collected in collector chamber 45, from which they can be recirculated into the closed system, or be expelled into the atmosphere. Hence, any mixing that these gas bubbles may cause is confined to conduit 2.

Third, gas bubbles which do not dissolve in conduit 2 will be discharged through outflow aperture 12. In the preferred embodiment shown in FIG. 1, outflow aperture 12 directs discharge flow path 14 in a direction which is generally horizontal. Gas bubbles discharged through outflow aperture 12 flow upward toward interceptor means 48. At interceptor means 48 gas bubbles are collected and directed through interceptor gas line 50, and out of hypolimnion 62. By proceeding out of hypolimnion 62 through interceptor gas line 50, as opposed to continuing upward through thermocline 64, the rising gas bubbles do not cause mixing of hypolimnion water with water in a stratum above hypolimnion 62. Furthermore, by virtue of positioning interceptor means 48 above discharge flow path 14, hypolimnion water which is carried in a upward flow path towards interceptor means 48 is deflected from its upward flow path by interceptor means 48 and thus remains in hypolimnion 62. This further prevents the mixing of hypolimnion water with water in the strata above hypolimnion 62.

Recovery and conservation of the gases supplied to the water, and hence the efficiency of the invention, is facilitated as follows. First, collector means 42 may recirculate gases collected therein back into conduit 2 by means of collector gas line 47. Second, interceptor means 48 may recirculate gases collected therein back into conduit 2 by means of interceptor gas line 50. In the preferred embodiment discussed above, the recirculated gases are reintroduced into horizontal chamber 6. In this embodiment, the invention provides a means for reintroducing gases at a pressure which is near atmospheric, hence no secondary gas pump or other gas pressurizer is required. In a further preferred embodiment discussed above, the recirculated gases are reintroduced into horizontal chamber 6 adjacent to impeller means 28, hence facilitating the mixing of the recirculated gases and the water in conduit 2.

By collecting bubbles which exit conduit 2, and by intercepting the upward flow of water, the water flow rate in conduit 2 can be relatively high without air bubbles escaping and causing a mixing of the strata. It is advantageous to allow for a sufficiently high flow rate of hypolimnion water within conduit 2 to limit any significant heat transfer between the hypolimnion water which passes through conduit 2, as at least a portion of conduit 2 may be in epilimnion 66. Thus, without a reasonably high water flow, there may be a need for expensive and weighty insulation on conduit 2. It is also desirable to allow for a higher flow rate within conduit 2 to achieve efficient oxygenation in the body of water.

It will be understood that no limitation of the scope of the invention is hereby intended. While the invention has been disclosed and described with reference to a limited number of embodiments, those skilled in the art will appreciate that the various modifications, variations and additions to the process may be made, and it is therefor intended in the following claims to cover each such variation, addition and modification as falls within the true spirit and scope of the invention. Such alterations and further modifications in the illustrated device, and such applications of the principals of the invention as it is illustrated therein as would normally occur to one skilled in the art to which the invention relates, are considered as included in the invention.

I claim:

1. Apparatus for introducing oxygen into a selected subsurface stratum of a thermally stratified body of water, while maintaining the thermal stratification thereof substantially undisturbed, comprising:

(a) a conduit including an inflow aperture for receiving water, an upflow chamber, a horizontal chamber, a downflow chamber, and an outflow aperture for discharging water from said conduit in a discharge flow path, said conduit defining a closed flow path for water entering said inflow aperture, said flow path extending upwardly through said upflow chamber, through said horizontal chamber, downwardly through said downflow chamber, and through said outflow aperture, said inflow aperture and said outflow aperture adapted to be positioned within said selected subsurface stratum;

(a) aerator means for introducing oxygen within said conduit, said aerator means positioned in said upflow chamber or adjacent to said inflow aperture;

(b) impeller means for assisting flow of water through said conduit and for mixing water in said conduit with oxygen, said impeller means positioned in said conduit between said aerator means and said outflow aperture;

(c) collector means for collecting undissolved gas within said conduit, said collector means positioned on said horizontal chamber; and (d) interceptor means for collecting undissolved gas from said discharge flow path, and for preventing vertical circulation of water discharged from said outflow aperture, said interceptor means positioned over and above said discharge-flow path and within said selected subsurface stratum.

2. Apparatus as claimed in claim 1 wherein said upflow chamber is substantially vertically extending.

3. Apparatus as claimed in claim 1 wherein said downflow chamber is substantially vertically extending.

4. Apparatus as claimed in claim 1 wherein said inflow aperture and said outflow aperture are positioned a distance of between 4 and 40 metres from said horizontal chamber.

5. Apparatus as claimed in claim 1 wherein said impeller means is positioned in said horizontal chamber between said upflow chamber and said collector means.

6. Apparatus as claimed in claim 1 wherein said collector means is positioned over and above said downflow chamber.

7. Apparatus as claimed in claim 1 further comprising an interceptor gas return means for returning gas from said interceptor means to said conduit.

8. Apparatus as claimed in claim 1 further comprising a collector gas return means for returning gas from said collector means to said conduit.

9. Apparatus as claimed in claim 1 further comprising an interceptor gas return means for returning gas from said interceptor means to said horizontal chamber.

10. Apparatus as claimed in claim 1 further comprising a collector gas return means for returning gas from said collector means to said horizontal chamber.

11. Apparatus as claimed in claim 1 further comprising an interceptor gas return means for returning gas from said interceptor means to a position adjacent to said impeller means, said impellor means positioned in said horizontal chamber.

12. Apparatus as claimed in claim 1 further comprising a collector gas return means for returning gas from said collector means to a position adjacent to said impeller means, said impellor means positioned in said horizontal chamber.

13. Apparatus as claimed in claim 1 wherein said conduit is secured to a floatation means for raising and lowering said conduit in water.

14. A method for introducing oxygen into a selected subsurface stratum of a thermally stratified body of water, while maintaining the thermal stratification thereof substantially undisturbed, comprising:

(a) drawing water upwardly from said selected subsurface stratum into a conduit having a closed flow path;

(b) causing said water drawn in to flow upwardly;

(c) introducing oxygen into said upwardly flowing water;

(d) causing said water in said flow path to flow substantially horizontally;

(e) mixing said water and said oxygen in an impeller means;

(f) causing said water in said flow closed path to flow downwardly;

(g) collecting undissolved gas at a portion of said closed flow path horizontally adjacent to the surface of said body of water;

(h) discharging said water from said closed flow path into said selected subsurface stratum in a discharge flow path; and (i) within said subsurface stratum, collecting undissolved gas from said flow path and limiting upward movement of water from said discharge flow path.

15. A method as claimed in claim 14 wherein said closed flow path is substantially submerged in said body of water.

16. A method as claimed in claim 14 wherein said subsurface stratum is between 4 and 40 metres under the surface of said body of water.

17. A method as claimed in claim 14 wherein introducing oxygen into said water in step (c) substantially occurs in said subsurface stratum.

18. A method as claimed in claim 14 further comprising accelerating the flow of said water in said conduit.

19. A method as claimed in claim 18 wherein the flow of said water in said conduit is accelerated such that there is substantially no heat transfer between said water in said conduit and water near the surface of said body of water.

20. A method as claimed in claim 14 further comprising returning gas collected in step (g) or step (i) to said conduit.

21. A method as claimed in claim 14 wherein in step (d) said flow path is adjacent to the surface of said body of water.

22. A method as claimed in claim 21 further comprising returning gas collected in step (g) or step (i) to a portion of said closed flow path horizontally adjacent to said surface of said body of water.

* * * * *